US005685286A

United States Patent [19]

Summers

[11] Patent Number: 5,685,286

[45] **Date of Patent: *Nov. 11, 1997**

[54] BOWSTRING RELEASE DEVICES

[76] Inventor: Gregory E. Summers, 105 Overlink Ct., Lynchburg, Va. 24503

[ * ] Notice: The term of this patent shall not extend beyond the expiration date of Pat. No. 5,680,851.

[21] Appl. No.: 422,537

[22] Filed: Apr. 14, 1995

Related U.S. Application Data

[63] Continuation-in-part of Ser. No. 395,435, Feb. 28, 1995.

[51] Int. Cl.[6] ..... F41B 5/18

[52] U.S. Cl. ..... 124/35.2

[58] Field of Search ..... 124/35.2, 91

[56] References Cited

U.S. PATENT DOCUMENTS

| | | | |
|---|---|---|---|
| 2,417,791 | 3/1947 | Tyszkiewicz | 124/35.2 |
| 2,488,597 | 11/1949 | Konold | 124/35.2 |
| 2,637,311 | 5/1953 | Rose | 124/35.2 |
| 2,819,707 | 1/1958 | Kayfes et al. . | |
| 2,905,166 | 9/1959 | Niemeyer | 124/91 |
| 2,965,093 | 12/1960 | Arsenault | 124/35.2 |
| 2,977,952 | 4/1961 | Gabriel et al. | 124/35.2 |
| 3,847,133 | 11/1974 | Awiszus | 124/91 |
| 4,086,904 | 5/1978 | Suski et al. | 124/90 |
| 4,134,369 | 1/1979 | Cook | 124/35.2 |
| 4,151,825 | 5/1979 | Cook | 124/35.2 |
| 4,282,851 | 8/1981 | Lyons | 124/35.2 |
| 4,509,497 | 4/1985 | Garvison | 124/35.2 |
| 4,539,968 | 9/1985 | Garvison | 124/35.2 |
| 4,620,523 | 11/1986 | Peck | 124/35.2 |
| 4,656,994 | 4/1987 | Jenks | 124/91 X |
| 4,674,469 | 6/1987 | Peck | 124/35.2 |
| 4,691,683 | 9/1987 | Peck | 124/35.2 |
| 4,722,319 | 2/1988 | Brady | 124/35.2 |
| 4,791,908 | 12/1988 | Pellis | 124/35.2 |
| 4,881,516 | 11/1989 | Peck | 124/35.2 |
| 4,909,233 | 3/1990 | Stephenson | 124/91 |
| 4,926,835 | 5/1990 | Peck | 124/35.2 |
| 4,981,128 | 1/1991 | Garvison | 124/35.2 |
| 5,016,603 | 5/1991 | Tentler | 124/91 |
| 5,020,508 | 6/1991 | Greene, Jr. | 124/35.2 |
| 5,027,786 | 7/1991 | Peck | 124/35.2 |
| 5,070,854 | 12/1991 | Peck | 124/33.2 |
| 5,076,251 | 12/1991 | Peck | 124/35.2 |
| 5,078,116 | 1/1992 | Peck | 124/35.2 |
| 5,103,796 | 4/1992 | Peck | 124/35.2 |
| 5,170,771 | 12/1992 | Peck | 124/35.2 |
| 5,170,772 | 12/1992 | Hamm | 124/35.2 |
| 5,247,921 | 9/1993 | Todd | 124/35.2 |
| 5,263,466 | 11/1993 | Peck | 124/35.2 |
| 5,318,004 | 6/1994 | Peck | 124/35.2 |
| 5,359,983 | 11/1994 | Peck | 124/35.2 |
| 5,361,747 | 11/1994 | Laabs | 124/91 |
| 5,370,102 | 12/1994 | Peck | 124/35.2 |

*Primary Examiner*—John A. Ricci
*Attorney, Agent, or Firm*—Nixon & Vanderhye P.C.

[57] ABSTRACT

A bowstring release device comprising a first housing; a pair of spring biased gripping arms pivotally secured within the first housing for movement toward and away from each other, the gripping arms each having at least one jaw; ball actuator means mounted in the first housing for moving the gripping arms between open and closed positions; a second housing secured to the first housing and axially aligned therewith; a firing pin slidably mounted in the second housing and adapted for engagement with the actuator means; and a handle mechanism secured to the second housing and including an element adapted to operatively engage the firing pin.

33 Claims, 8 Drawing Sheets

BOWSTRING RELEASE DEVICES

RELATED APPLICATIONS

This application is a continuation-in-part of my co-pending application Ser. No. 08/395,435, filed Feb. 28, 1995.

BACKGROUND OF THE INVENTION

In the field of archery, it is conventional for an arrow to be provided with a string engaging fork, also known as an arrow nock, at the rear end of the arrow. It is also known to provide a bowstring nock which locates the arrow nock on the bowstring to facilitate good aim of the arrow. Accordingly, the bowstring nock must be located on the bowstring substantially at the center of the string and substantially horizontally aligned with the point at which the forward end of the arrow is supported at the center of the bow. Representative bowstring nocks are described, for example, in U.S. Pat. Nos. 5,361,747; 4,909,233; and 2,905,166.

It is also known to provide various forms of hand held gripping and firing devices designed to cooperate with a bowstring nock that enable an archer to apply a strong pull to the bowstring and to release the arrow without having to grip the end of the arrow and the bowstring with the fingers. See, for example, U.S. Pat. Nos. 5,016,603 and 4,930,485. U.S. Pat. No. 4,930,485 discloses a half loop shaped center nock having two ends attached to the bowstring, in combination with a bowstring drawing device which includes a releasable draw pin that engages the half loop portion of the nock. The drawing device also includes a trigger designed to release the bowstring upon operation of the trigger. Other release devices are described in U.S. Pat. Nos. 5,247,921; 5,170,772; 5,020,508 and 4,926,835.

SUMMARY OF THE INVENTION

This invention relates to improved release devices which are particularly suited for use with ball-shaped bowstring nocks, but which are also readily adaptable for use with bowstrings per se. The release devices in accordance with this invention, which may be adapted for use with single or double nock arrangements, incorporate caliper style jaws. These jaws are formed as semi-spherical sockets at the ends of respective gripping arms so as to readily conform to and grasp a substantially spherical ball nock, but it will be appreciated that the jaws may also be configured to grip a bowstring which has no nock elements attached thereto. The gripping arms and an internal ball and spring actuator for the gripping arms are substantially as disclosed in my copending application Ser. No. 08/395,435, filed Feb. 28, 1995, which is incorporated herein by reference. Briefly, the gripping arms are movable between closed and open positions (they are normally biased to a closed position) by means of the internal ball actuator and coil (or other) spring, such that axial movement of a firing pin, as described in further detail herein, causes axially forward movement of the ball actuator against the forces exerted by the spring. This movement of the ball actuator, in turn, allows the inner ends of the gripping arms to pivot inwardly toward each other as the outer ends of the gripping arms to pivot outwardly away from each other under the influence of the spring to thereby release the arrow via the now released ball nock (or bowstring). Thus, the ball actuator has two significant functions. On the one hand, forward movement of the ball clears the way for inward movement of the inner ends of the gripping arms, and on the other hand, compression of the spring by the ball actuator causes the spring to act on engagement surfaces of the gripping arms which effects the pivoting movement of the arms. The invention here relates to new generally T-shaped handle and/or trigger mechanisms for use with my earlier release device which permits selection of a handle configuration which is particularly suited to the needs of the user.

In a first exemplary embodiment, the gripping arms are mounted in a first housing for pivotal movement toward and away from each other in the manner fully described in the '435 application. This first housing is rotatably secured to a second axially aligned swivel housing, allowing the first housing to freely rotate relative to the second housing about a common center axis. A handle is pivotally secured at the rearward end of the second housing for movement about an axis perpendicular to the common center axis. A firing pin is slidably mounted within the second or swivel housing and includes a pin projecting forwardly of a cylindrical main body portion adapted to engage the ball actuator in the first housing. The handle mechanism includes a hinge pin projecting forwardly out of the handle. The hinge pin is pivotally secured to the swivel housing. This hinge pin includes a flange which mounts an adjustable screw which is adapted to engage the firing pin. Thus, angular or pivotal movement of the handle will cause the firing pin to move forwardly, displacing the ball actuator so that the gripping jaws are forced away from each other to a nock release position.

This first release mechanism incorporates three distinct adjustments, allowing individual preference for fit, function and feel. The release is essentially triggerless, and fires upon the angular motion of the handle thus eliminating "trigger jerk". The firing angle is adjustable through adjustment of the screw secured to the hinge pin and adapted to engage the firing pin. More specifically, the adjustable screw is off center relatively to the common center axis of the two housing so that, for example, increasing the effective screw length changes the angle of the handle relative to the common center axis.

The draw length is adjustable by moving the hinge pin forwardly or rearwardly relative to the handle. In the exemplary embodiment, once the hinge pin is correctly located, a set screw is utilized to lock the hinge pin in place.

Adjustment of the hinge angle between the second housing and the handle can be accomplished by unlocking the hinge pin, and then rotating the pin (or handle, relative to the pin) clockwise or counter-clockwise to the desired firing angle between the firing pin and the handle (without necessarily also changing the draw length to any significant extent), and then relocking the hinge pin relative to the handle.

It will be appreciated that the above described release mechanism handle may be adapted for two finger, three finger or four finger (shown in the drawings) engagement for use with light to heavy pound draw force compound bows. This additional degree of flexibility is easily accommodated at the manufacturing stage of the device.

Because the first housing is rotatable relative to the second housing, there is also a built in 360° swivel action for total freedom of the archer's hand motion during and after the draw, without disturbing the gripping arm orientation.

The above described caliper release provides the following advantages:

(1) Eliminates bi-directional forces exerted by the archer during and after the draw.

(2) Increases accuracy of the arrow flight.

(3) Eases the effort of the archer during the draw.

(4) Triggerless design eliminates "trigger jerk" for the highest accuracy of the competition archer.

(5) Absolute accuracy of position for arrow and release on the bowstring at all times.

(6) Quick and easy attachment of the release to the bowstring with the use of only one hand.

(7) The ball actuator/ramp inner gripping arm design provides quiet release.

(8) Easy adjustment of the firing angle, draw length and firing pin to handle angle for archer preference and fit.

(9) Elimination of bowstring wear due to direct contact with the bowstring mounted ball nock.

(10) Built in 360° swivel for freedom of archer hand position during and after the draw.

(11) When used in conjunction with a string mounted ball nock, the latter remains in position under the arrow nock throughout arrow propulsion, thus maintaining arrow flight accuracy and reducing arrow porpoising, replacing the void where all prior release devices were in position at full draw but removed at the point of fire.

In a second exemplary embodiment of the invention, a thumb push trigger device is built into the T-shaped handle for cooperation with aligned firing pins adapted to engage the ball actuator located between the gripper arms. More specifically, a thumb push trigger is pivotally secured within an open slot extending across the back of the handle, with the thumb push trigger including an adjustable set screw adapted to engage a first firing pin slidably mounted within the handle. This firing pin is adapted to engage a second and axially shorter firing pin located within the second housing. In this second exemplary embodiment, the first and second housings as well as the T-handle, are all relatively rotatable one with respect to the other about a common center axis. By pushing the thumb trigger forward relative to the handle, the firing pins in turn engage the ball actuator, pushing it forward against the action of the coil spring, thereby causing and allowing the gripping arms to open to a full release position. Because the distance between the thumb trigger set screw and the first firing pin is adjustable, hair trigger sensitivity can be provided if desired.

In a third exemplary embodiment of the invention, the release is essentially similar to the second embodiment described hereinabove with the exception that the thumb push trigger is replaced by a pinky pull trigger pivotally secured within the open slot in the T-handle. The features, advantages and manner of operation of this embodiment are essentially the same as for the previously described embodiment, with the exception that the trigger is activated by a pinky finger pull motion rather than a thumb push motion.

In a fourth exemplary embodiment of the invention, the trigger is activated by a thumb pull motion, allowing the competition archer back tension motion or pull trigger motion activated by the thumb. Here again, the trigger is engageable with a first firing pin slidably mounted in the T-handle. This embodiment has essentially all of the features and advantages of the earlier described embodiments, but provides the archer with a further degree of flexibility with respect to trigger actuation.

It will be appreciated that all of the release mechanisms described above can be modified to the extent of incorporating gripping arms which each provide a pair of semi-spherical sockets, in a double wishbone configuration. This arrangement is to be used with a double bowstring nock arrangement so that the ball-shaped nocks on either side of the arrow nock can be securely gripped by the gripping arms of the release device.

The wishbone double ball jaw caliper provides a straight string behind the arrow (i.e., perpendicular to the arrow) and a free swivel motion with the pull forces exerted directly behind the arrow along with elimination of bowstring wear.

It should be noted here that each of the release devices described herein can incorporate single ball nock, double ball nock or standard string jaw configurations. In addition, the T-handle of each release can be readily produced in two, three or four finger form.

In accordance with its broader aspects, the present invention relates to a bowstring release device comprising a first housing; a pair of spring biased gripping arms pivotally secured within the first housing for movement toward and away from each other; ball actuator means mounted in the first housing for moving the gripping arms between open and closed positions; a second housing secured to the first housing and axially aligned therewith; a firing pin slidably mounted in the second housing and adapted for engagement with the actuator means; and a combined handle and trigger mechanism secured to the second housing and including an element adapted to operatively engage the firing pin.

In another aspect, the invention provides a bowstring release device comprising a housing; a pair of spring biased gripping arms, each having at least one jaw, pivotally secured in the housing for movement between closed gripping and open releasing positions; a spring biased ball actuator for moving the gripping arms between the closed gripping and open releasing positions; a firing pin axially aligned with the spring biased actuator; and handle means for effecting movement of the firing pin and the spring biased actuator so as to cause the gripping arms to move from the closed gripping to the open releasing position.

Additional objects and advantages of the invention will become apparent from the detailed description which follows.

DETAILED DESCRIPTION OF THE DRAWINGS

Figure 1:
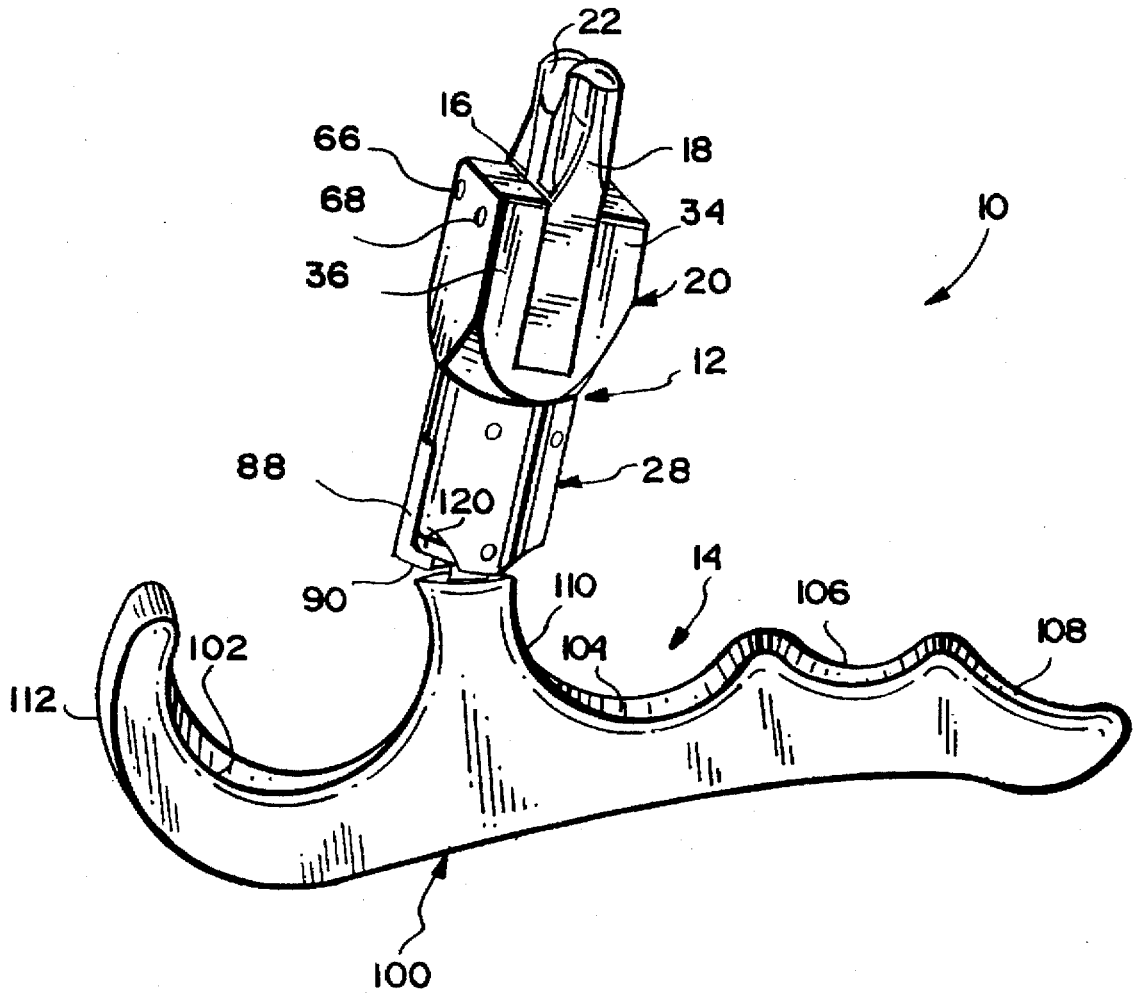
FIG. 1 is a perspective view of a single nock release in accordance with a first embodiment of the invention.
Figure 2:
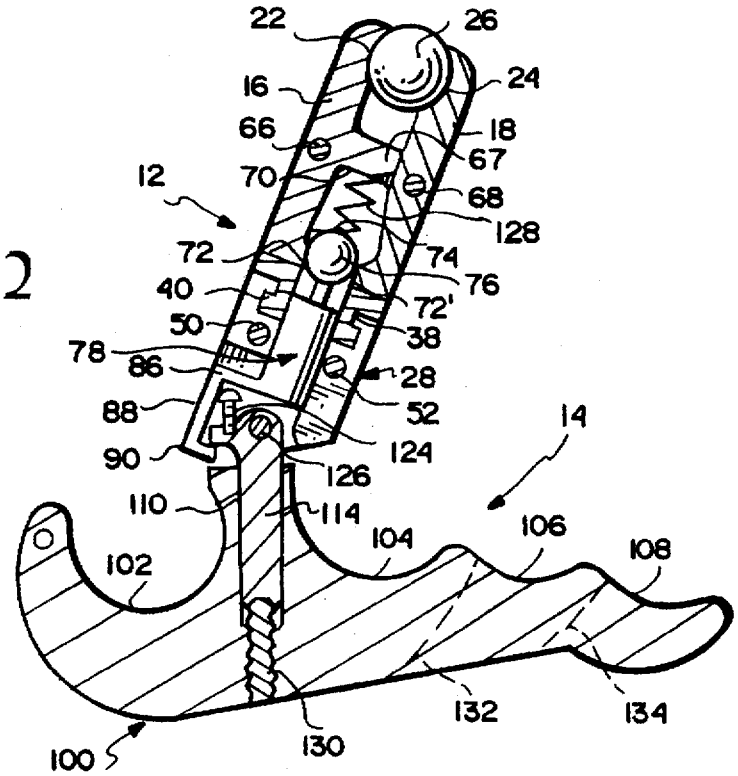
FIG. 2 is a sectional view of a single nock release similar to that shown in FIG. 1, with the gripping arms shown in a closed or locked position.
Figure 3:
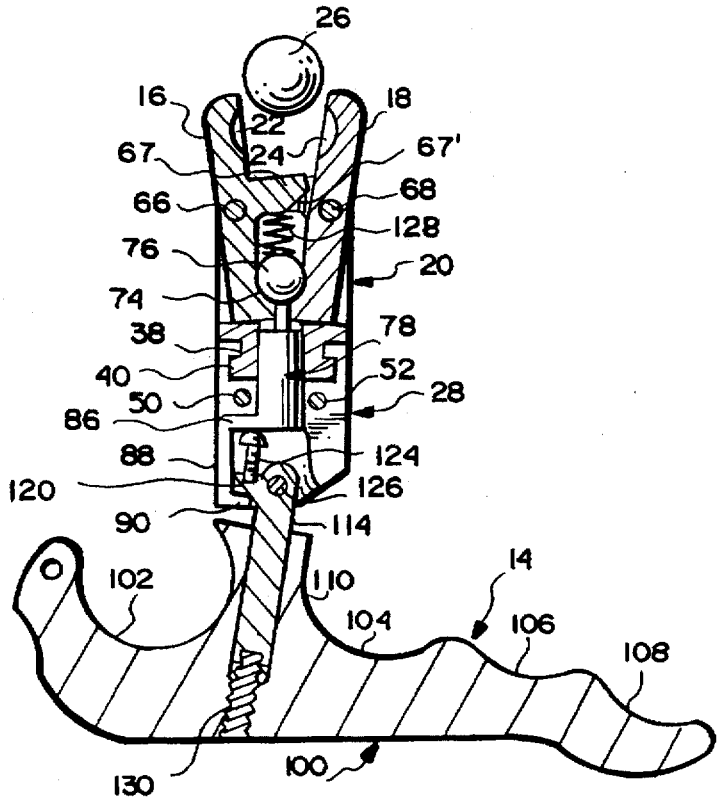
FIG. 3 is a section of the single nock release shown in FIG. 2 with the gripping jaws shown in an open or release position.
Figure 4:
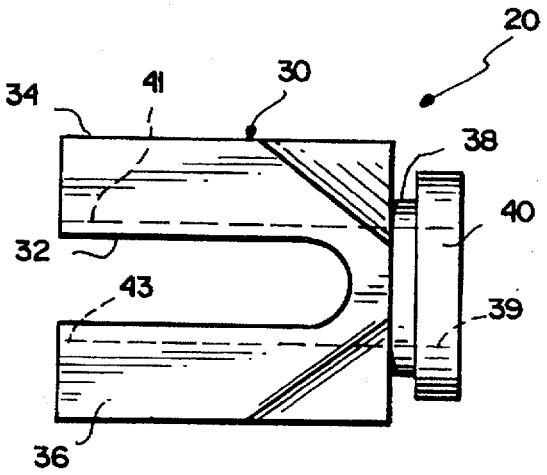
FIG. 4 is a side elevation of a first housing element incorporated within the release shown in FIGS. 1–3.

Referring to FIGS. 1–3, the release 10 includes, generally, a nock release mechanism 12 and a generally T-shaped actuator handle or grip 14. The release mechanism 12 includes a pair of spring loaded gripping arms 16 and 18 which are pivotally mounted in a first housing 20. The gripping arms terminate at generally semi-spherical jaws or sockets 22, 24, respectively, which are adapted to engage a ball nock (represented by ball 26 in FIGS. 2 and 3) secured to a bowstring. As described in further detail below, a slight pivoting motion of the actuator handle or grip 14 relative to the release mechanism 12 will cause the arms 16 and 18 to pivot away from each other to thereby release the nock and, hence, the bowstring and arrow (see FIG. 3).

With reference now also to FIGS. 4 through 7, the housing 20 is attached to an axially aligned swivel housing 28 such that the housing 20 and 28 are relatively rotatable about a common longitudinal center axis. The housing 20 includes a generally solid body 30, formed to include an open ended slot 32 at the forward end thereof, thus creating a pair of spaced sides 34, 36 with the slot 32 opening forwardly. The block 30 has a generally square cross-section at its forward end, but which is machined at its rearward corners to provide a round cross section at its rearward end. The rear end of the housing 20 is formed with a reduced diameter stem 38 and an enlarged, disk-like head 40 which has a diameter greater than the stem 38 but less than the side dimensions of the housing body 30. The housing 20 is also provided with an internal bore 39 which extends through the stem 38 and head 40. The bore has a diameter greater than the distance between sides 34, 36 so that by continuing the boring operation through the entire length of the housing, opposed grooves 41 and 43 are formed in the opposed sides 34, 36.

Figure 6:
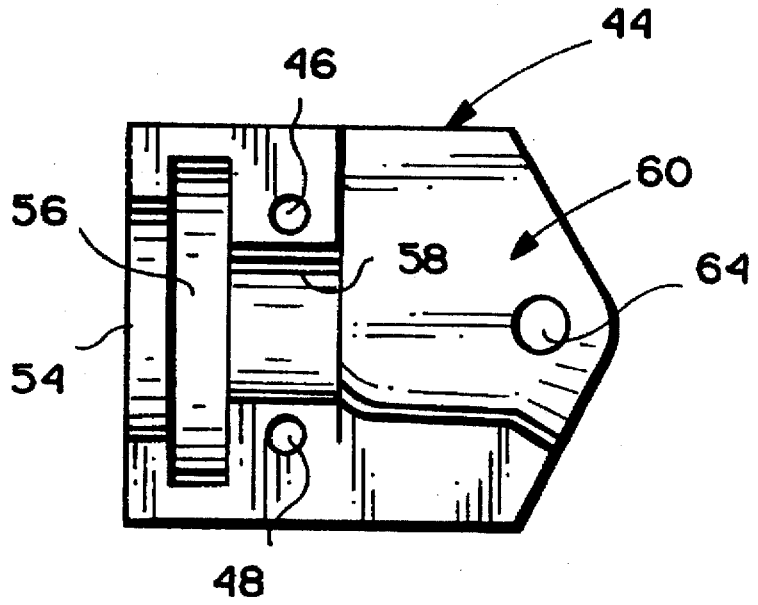
FIG. 6 is a side elevation of a split half portion of a second housing incorporated in the release mechanism shown in FIGS. 1–3.
Figure 7:
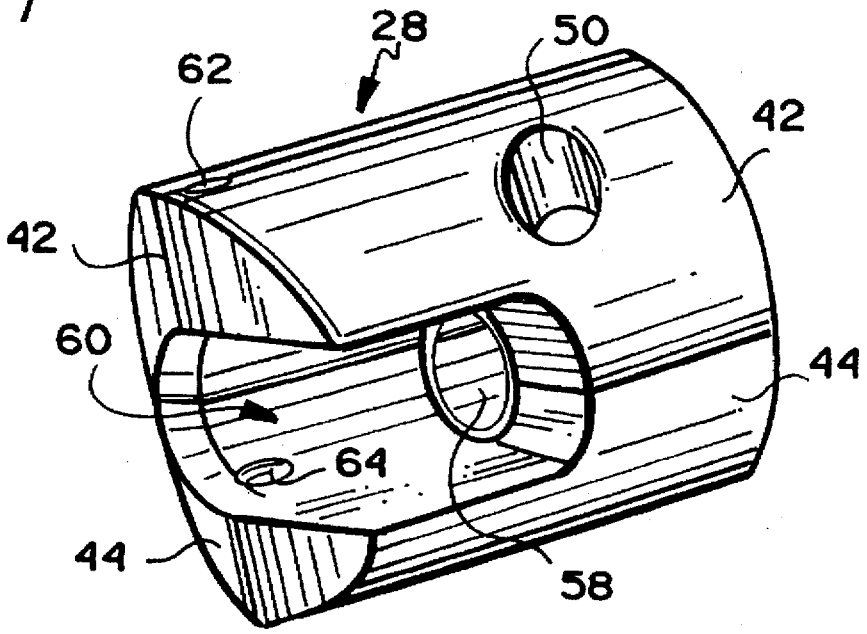
FIG. 7 is a perspective view of the assembled second housing comprising two mirror image split portions of the type shown in FIG. 6.

The disk-like head 40, in conjunction with axial stem 38, allow the housing 20 to be rotatably secured within the swivel housing 28 shown in FIGS. 6 and 7. Specifically, the housing 28 is generally cylindrical in shape, formed as a pair of split halves 42, 44, which are mirror images of each other. These half sections may be secured together by screw fasteners extending through smooth bore holes 46, 48 in one half section (e.g., 44) of the housing and into aligned threaded holes 50, 52 in the other half section (e.g., 42). In the assembled state, the swivel housing 28 is shaped to include a short, axial bore 54 which opens to a similarly short but larger diameter bore 56. The smaller bore 54 receives the reduced diameter stem or neck 38 of the housing 20, while the larger bore 56 receives the enlarge disk-like head 40. It will be appreciated that when the housing sections 42, 44 are fastened together via the screw fasteners as described above, the housing 20 is captured within the forward end of housing 28 but freely rotatable relative thereto, about a common longitudinal center axis.

A reduced diameter bore 58 extends rearwardly from the disk receiving bore 56, between the fastener holes 46, 48, 50 and 52. This bore is adapted to slidably receive a firing pin as described in further detail below. Behind the bore 58, the housing 28 is formed to include as relatively larger recessed area 60, open along one side and the rear of the housing to accommodate the connection between the release mechanism 12 and the handle 14 as described in detail below. The housing 28 is also provided with aligned pivot pin holes 62, 64 by which the handle 14 is pivotally secured to the release mechanism 12.

Returning to FIGS. 2 and 3, the gripping arms 16, 18 are pivotally secured within the housing 20 by means of pins 66, 68 extending through aligned holes (two shown at 70, 72 in FIG. 5) in the sides 34, 36 and in arms 16, 18.

It will be understood that the arm 16 is a mirror image of arm 18 and, thus, only arm 16 will be described in detail. The arm 16, in addition to the nock receiving socket or jaw 22, also includes a pivot pin bore which receives the pin 66 by which the arm 16 is pivotally mounted in the housing 20. A spring engaging extension 67 projects transversely of the arm proper, and, as described in the '435 application, is laterally offset from the longitudinal center axis of the arm. In other words, the extension 67 of arm 16 and similar extension 67' of arm 18 lie in flush engagement with each other, while arms 16 and 18 are substantially co-planar, with sockets 22, 24 in both vertical and horizontal alignment. The extension 67 is formed with a spring engagement surface 70, the purpose for which will be described below. The arm 16 also includes a rearward extension which includes a flat 72 and a curved ramp or cam surface 74, also described in further detail below.

Figure 5:
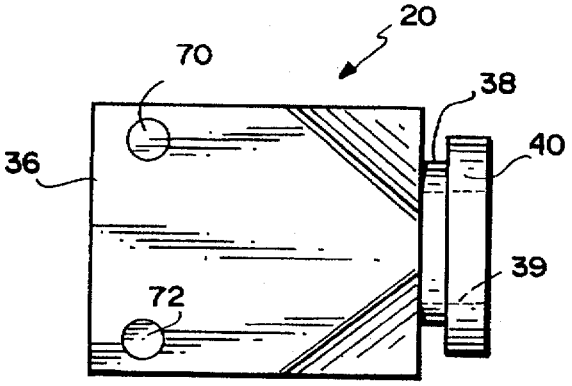
FIG. 5 is a bottom plan view of the housing shown in FIG. 4.
Figure 5A:
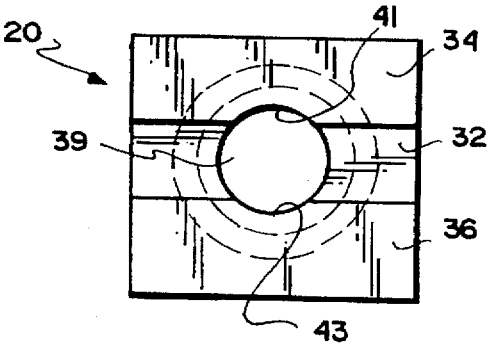
FIG. 5A is a front elevation of the housing shown in FIG. 4.

A solid ball actuator 76 is mounted within the housing 20 for movement within the opposed grooves 41, 43 (see FIG. 5A) extending along interior surface of housing sides 34, 36. At the same time, the ball 76 engages flats 72, 72' when the jaws are closed as shown in FIG. 2. It will be appreciated that when the ball actuator 76 is located as shown in FIG. 2, the gripping arms 16, 18 cannot pivot away from each other to a release position. When the ball actuator 76 is moved forwardly along grooves 41, 43 to the location shown in FIG. 3, with the actuator 76 also nested within the area formed by ramp or cam surfaces 74, 74', the gripping arms are free to pivot about the pins 66, 68 to a release position shown in FIG. 3.

Figure 8:
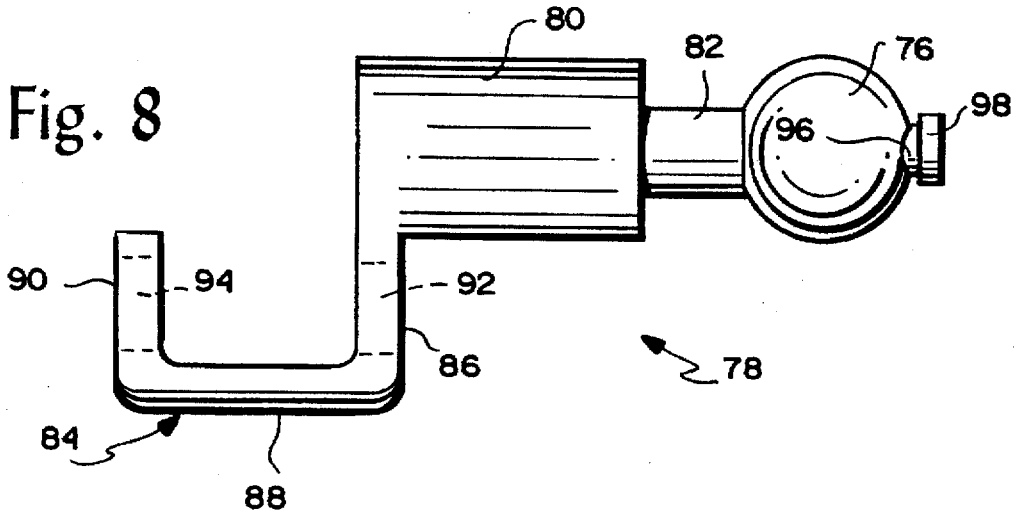
FIG. 8 is a side elevation of a combined firing pin ball actuator incorporated in the single nock release shown in FIGS. 1–3.
Figure 9:
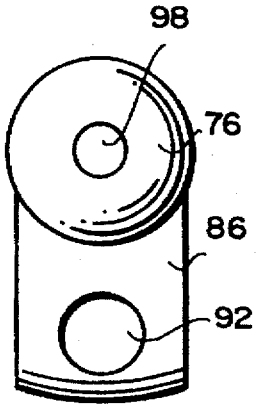
FIG. 9 is a front elevation of the firing pin/ball actuator shown in FIG. 8.
Figure 10:
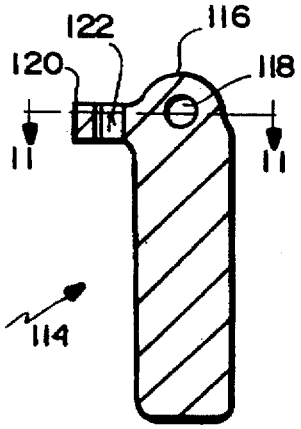
FIG. 10 is a side section of a hinge pin mounted in the handle of the single nock release shown in FIGS. 1–3.

The ball actuator 76 in this first embodiment is attached directly to a firing pin 78. The firing pin 78 is shown in detail in FIGS. 8 and 9, and includes a substantially cylindrical main body portion 80 which has a small diameter pin projection 82 extending from its forward end and a generally U-shaped hook or flange 84 extending laterally away from the cylindrical body at its opposite or rearward end. The hook 84 has a width approximating the diameter of the body 80 as best seen in FIG. 10. The hook 84 includes a first radial portion 86, an axial portion 88 and a second radial portion 90. The opposed radial portion 86 and 90 are formed with aligned, axially extending holes 92, 94, the purpose for which will be described further below. The firing pin 78 is mounted in the swivel housing 28, and specifically, body 80 is slidably engaged in the bore 58, for axial reciprocating movement therein. The forward end of the firing pin extends into the similarly sized, axially aligned bore 39 in the housing 20. At the forward end of the pin 78, the reduced diameter pin projection 82 mounts the ball actuator 76 via mounting pin 96 and head 98. In this way, the ball actuator is fixed with the pin 78 for axial movement therewith. The ball actuator 76 is free to rotate about the longitudinal axis of the firing pin 78. The firing pin 78 is shown in FIG. 2 in a normally closed position, where the firing pin 78 extends axially within both housings 20 and 28, and the ball actuator 76 is located axially so as to lie between the flats 72, 72' of gripping arms 16, 18.

Returning now to FIGS. 2 and 3, the T-handle 14 includes a hand grip member 100 formed with finger indentations or grooves 102, 104, 106, 108, with a connecting boss 110 extending between the grooves 102, 104 toward the release mechanism 12. The handle 14 is shaped and configured so that the user will grip the handle with the forefinger in groove 102, the middle finger in groove 104, the ring finger in groove 106 and the pinky in groove 108. The user's thumb would be normally pressed against the outside surface 112 of groove 102.

Figure 11:
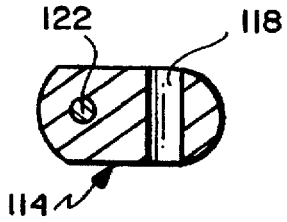
FIG. 11 is a section taken along the line 11—11 in FIG. 10.

The boss 110 is formed with a threaded bore for receiving an exteriorly threaded shank portion of a hinge pin 114. The latter is formed with a radiused head 116, formed with a transverse hole 118 (best seen in FIGS. 10 and 11). The hinge pin 114 also has a transversely extending flange 120 located axially between the radiused head 116 and the threaded shank portion of the pin 114. Flange 120 is formed with a threaded hole 122 for receiving an adjustment screw 124 (see FIGS. 2 and 3).

It can be seen that the T-handle 14 is pivotally secured to the release mechanism 12 by means of a pivot pin 126 anchored in holes 62, 64 of the swivel housing 28 and hole 118 in the radiused head 116 of the hinge pin 114. The pivot pin 126 is transverse to the common center axis of the housings 20 and 28, and allows the T-handle to pivot perpendicularly relative to housings 20 and 28, while also permitting the T-handle to rotate with the second housing 28 relative to the first housing 20, about the common center axis.

In the closed position shown in FIG. 2, the head of the adjustment screw 124 is located in close proximity to the underside of radial flange 86 of the firing pin 78, and offset from the common center axis.

It will be appreciated that by pivoting the T-handle 14 about pin 126, the head of screw 126 will engage and then move the firing pin 78 axially forward so that the ball actuator 76 moves in grooves 41, 43 beyond flats 72, 72' into the area between the ramp or cam surfaces 74, 74'. As a result, coil spring 128 interposed between the ball actuator 76 and transverse extensions 67, 67' of the arms 16, 18, will be compressed and will, in turn, cause arms 16, 18 to pivot about pins 66, 68 in opposite directions to thereby open the jaws to the release position shown in FIG. 3. Upon release of the handle 14, the coil spring 128 will push the ball actuator 76 and firing pin 78 rearwardly, with the actuator 76 engaging ramp or cam surfaces 74, 74', forcing the gripping arms 16, 18 back to the closed position shown in FIG. 2.

The U-shaped flange 84 at the rearward end of the firing pin 78 loops about the screw 126 and engages the underside of flange 120 on the hinge pin 114. This arrangement prevents any misfiring because the flange 120 prevents any forward movement of the firing pin 78, absent angular release motion imparted to the T-handle 14. This is particularly important when the user decides to re-set his firing position after an initial draw.

It will be appreciated that in use, after the release device has been manipulated as described above to lock onto a bowstring mounted ball nock, represented by ball 26, the user will pull the release rearwardly to a full draw position. With the axial tension applied to the device, the release mechanism assumes a stationary orientation, while the T-handle 14 may rotate easily relative thereto about the common longitudinal center axis. This allows the user to adjust his/her hand and wrist to the most comfortable position, without in any way affecting the draw. Then, only a slight pivoting motion of the T-handle about pin 126 (perpendicular to the longitudinal center axis) is required to move the firing pin 82 as described above to the position shown in FIG. 3, thereby releasing the bowstring nock represented by ball 26, in a smooth, triggerless action. It will be appreciated that adjustment of screw 124 enables elimination of any "lost motion" between the T-handle 14 and the firing pin 78, creating a "hair trigger" effect if desired. This also changes the initial angular position of the T-handle 14 relative to the common center axis of the release mechanism 12 at the point of firing. The hole 94 in the radial flange 90 permits access to the adjustment screw 124, and specifically to an allen wrench recess in the shank of the screw. Hole 92 is formed merely as an adjunct to the manufacturing process.

Additional user preference adjustments can be made by adjusting the length of hinge pin 114 which projects from the boss 110 of T-handle 14. This is accomplished by threading the hinge pin 114 in one or the other directions, depending on whether a lengthening or shortening of the draw length is desired. A set screw 130 extends through the hand grip portion 100 of the T-handle 14 and serves to lock the hinge pin in the desired location.

One further adjustment can be made in that loosening of the set screw 130 also allows the user to turn the handle 14 about the hinge pin 114 relative to the firing pin 78 and second housing 28.

As already indicated, the release described above can incorporate different jaw configurations for the gripping arms 16, 18, and different T-handle configurations, depending on whether 2, 3 or 4 finger engagement is desired. The latter possibilities are illustrated in phantom in FIG. 2—see dotted lines 132, 134.

In variations of the above described release devices as shown in FIGS. 12–17, the release mechanism is identical in terms of the gripping arms and spring biased ball actuator, unless otherwise noted. The respective T-handle and firing pin elements are different, however, so that only the latter elements need be described in detail.

Figure 12:
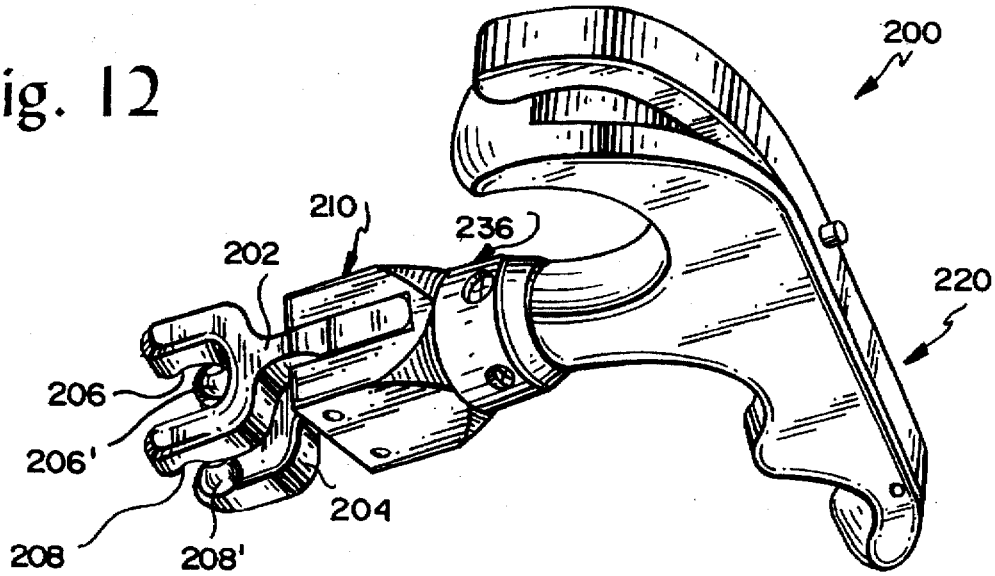
FIG. 12 is a perspective view of a double nock release in accordance with a second embodiment of the invention.
Figure 13:
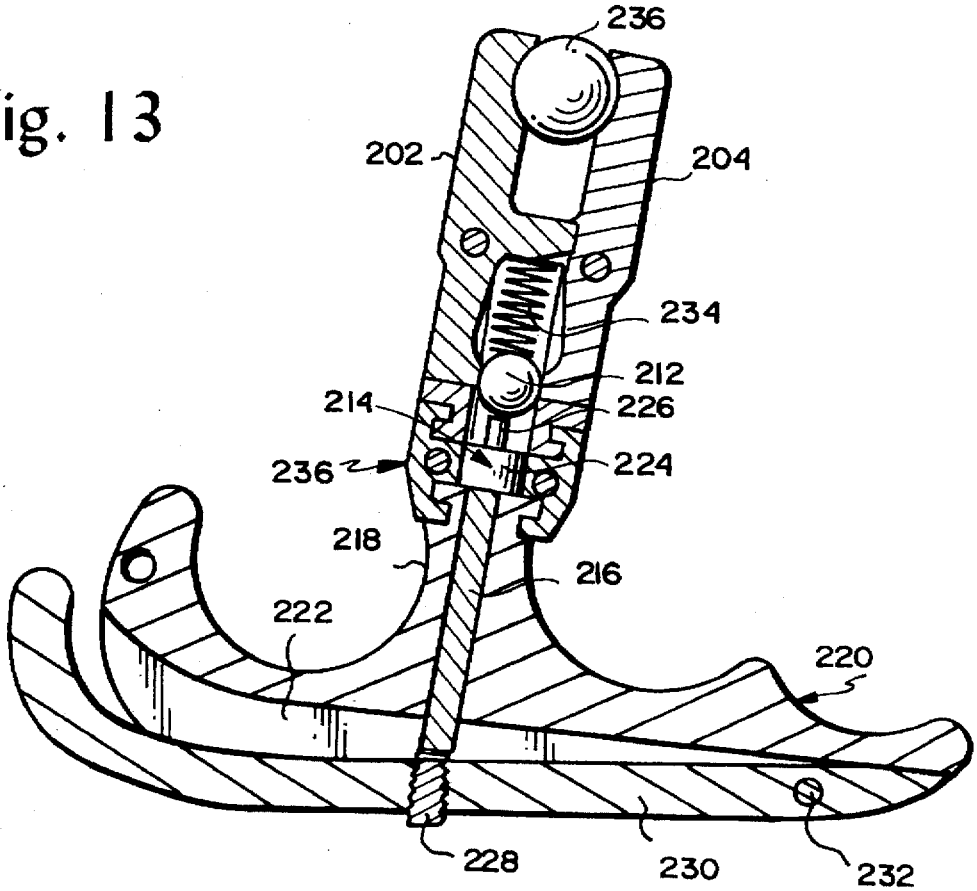
FIG. 13 is a section of the release mechanism shown in FIG. 12.

With specific reference to FIGS. 12 and 13, a double nock release 200 includes gripping arms 202, 204, each of which is branched in wishbone fashion to provide a pair of side-by-side semi-spherical sockets or jaws 206, 208 which cooperate with sockets or jaws 206' and 208', respectively, to releasably grip a pair of ball nocks (not shown) mounted on a bowstring so as to bracket the arrow nock. Otherwise, the mounting of the arms in the first housing 210, and the actuation and operation of the gripping arms 202, 2904 are as described above.

The double ball nock arrangement for the bowstring is fully disclosed in my copending '435 application. It will be appreciated that the gripping arms 202, 204 can be formed with a single ball nock or standard bowstring jaws as well.

With specific reference to FIG. 13, it can be seen that the ball actuator 212 is mounted within the opposed bore grooves in the first housing 210, but unlike the earlier described embodiment, is not attached to the firing pin. In this instance, the ball actuator 212 is engaged by a first axially aligned firing pin 214. A second, axially aligned firing pin 216 extends through the boss 218 of T-handle 220, and projects into an open slot 222 on the back side of the T-handle 220. The first firing pin 214 includes a cylindrical body portion 224 and a reduced diameter pin 226 projecting forwardly therefrom. The second firing pin 216 is a smooth rod-like member extending rearwardly through a bore in a boss portion 218 of the T-handle 220. The second firing pin 216 is adapted to be engaged by an adjustable set screw 228 mounted in a pivotally mounted, elongated thumb push trigger 230. It will be understood that adjustment of set screw 228 permits angular adjustment of the trigger 230 relative to the handle 220 and center axis.

The trigger 30 is mounted via a pin 232 for pivotal movement within the hollowed out slot 222. It will be appreciated from FIG. 13 that by pushing the thumb trigger 230 forwardly in a clockwise direction about the pin 232, the set screw 228 will engage the firing pin 216 causing the first firing pin 214 to move the ball actuator 212 forward against the resilient action of coil spring 234. This action will cause the gripping arms 202, 204 to pivot to an open position as described hereinabove, thereby releasing the ball nocks as represented by ball 236. Upon release, the coil spring will move the ball is actuator 276 and respective firing pins rearwardly until the gripping arms again assume the position shown in FIG. 13.

It should be noted here that the first housing 210 is rotatably connected to the second housing 236 in the same manner that housing 20 is connected to housing 28. In addition, the T-handle 220 is rotatably connected to the second housing 236 in a like manner, with a stem 238 and head 240 of T-handle 220 rotatably received in corresponding bore sections in the second housing 236. As a result, housing 210, housing 236 and handle 220 are all rotatable relative to each other about a common center axis extending through the housings. The handle 220 can be formed, and firing pin 216 located such that the handle itself is either perpendicular to the common center axis or angled relative thereto.

The T-handle 220 shown here is a three finger version, but the invention is not limited thereto.

Figure 14:
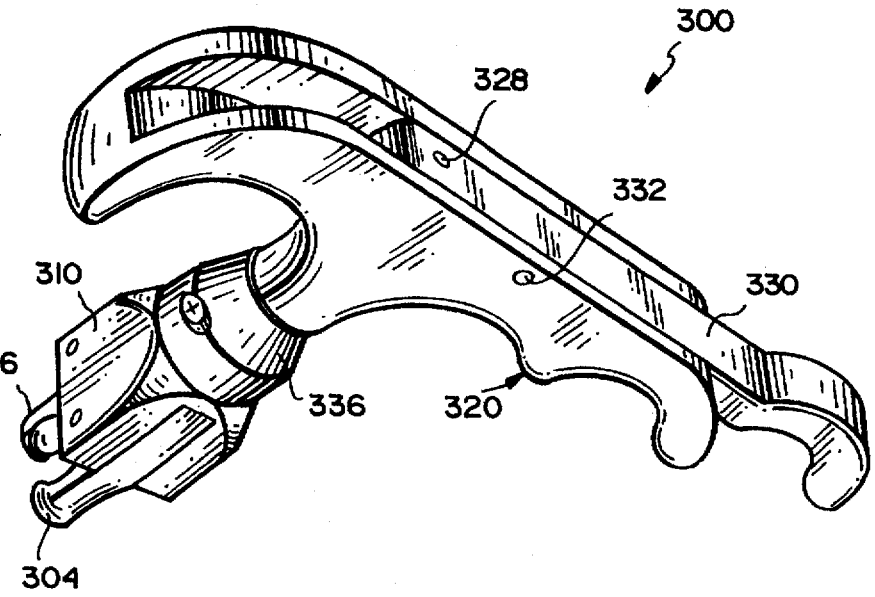
FIG. 14 is a single nock release mechanism in accordance with a third exemplary embodiment of the invention.
Figure 15:
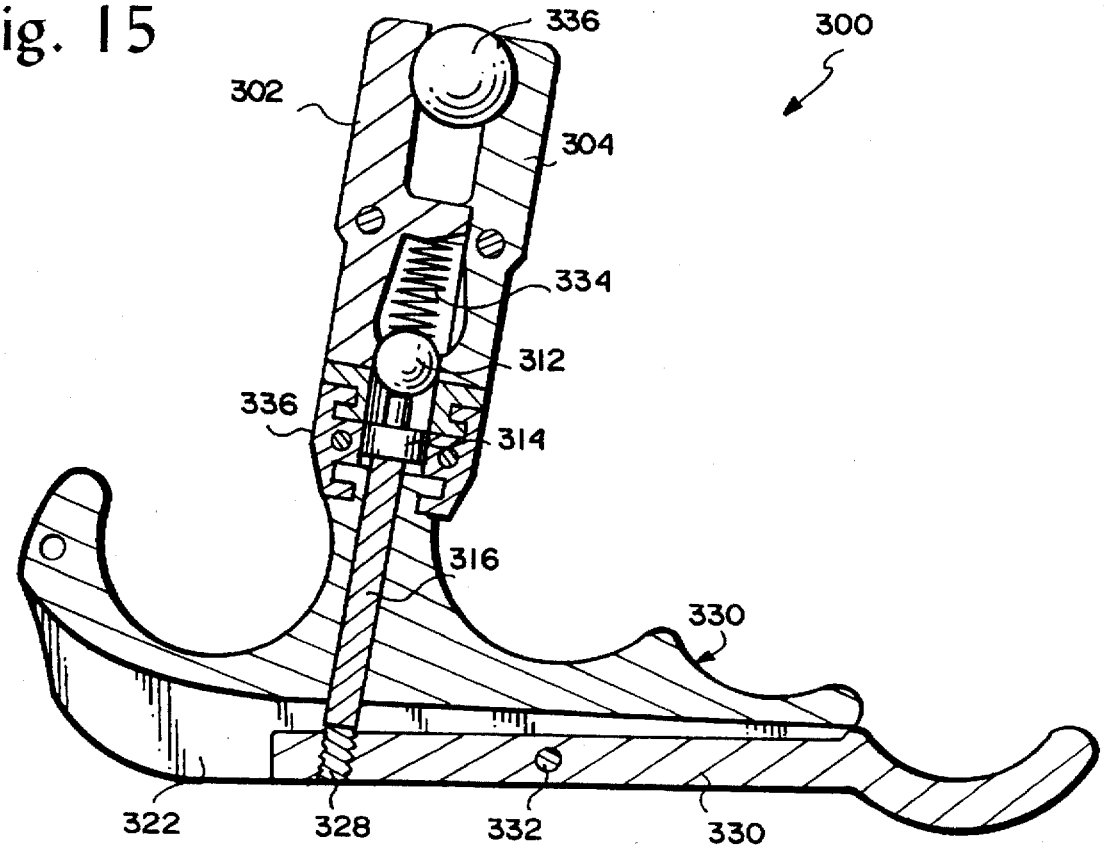
FIG. 15 is a section of the release shown in FIG. 14.

Turning to FIGS. 14 and 15, a release 300 is shown which is substantially identical to the release 200 shown in FIGS. 12 and 13, with the exception of the trigger. For convenience, similar reference numerals are used to designate corresponding elements, but with the prefix "3" added. The release 300 is shown as a single nock release, but can be provided with double nock or standard string jaws as well. In this embodiment, a pinky trigger 330 is pivotally secured within the open slot 322 of a three fingered T-handle 320 by means of a pin 332. To effect firing, the pinky trigger 330 is pulled in a clockwise direction about the pin 332 so that adjustable set screw 328 moves second firing pin 316 forwardly, causing first firing pin 314 and ball actuator 312 to move forwardly in the manner described hereinabove. The operation and adjustability features of the release 300 are otherwise the same as for the release 200. The principal distinction is merely one of user preference.

Figure 16:
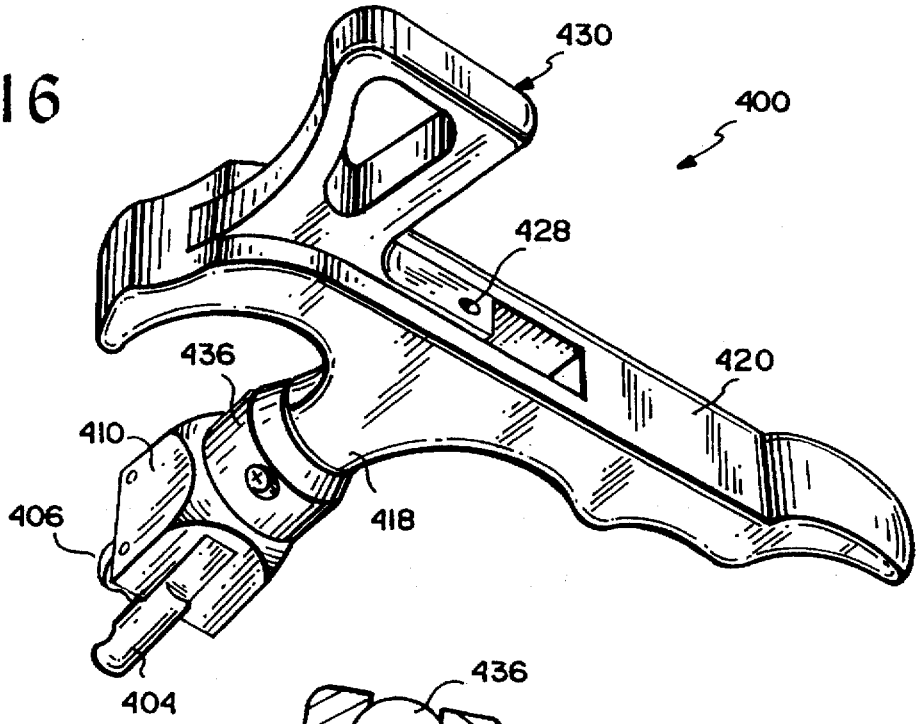
FIG. 16 is a perspective view of the single nock release in accordance with a fourth exemplary embodiment of the invention.
Figure 17:
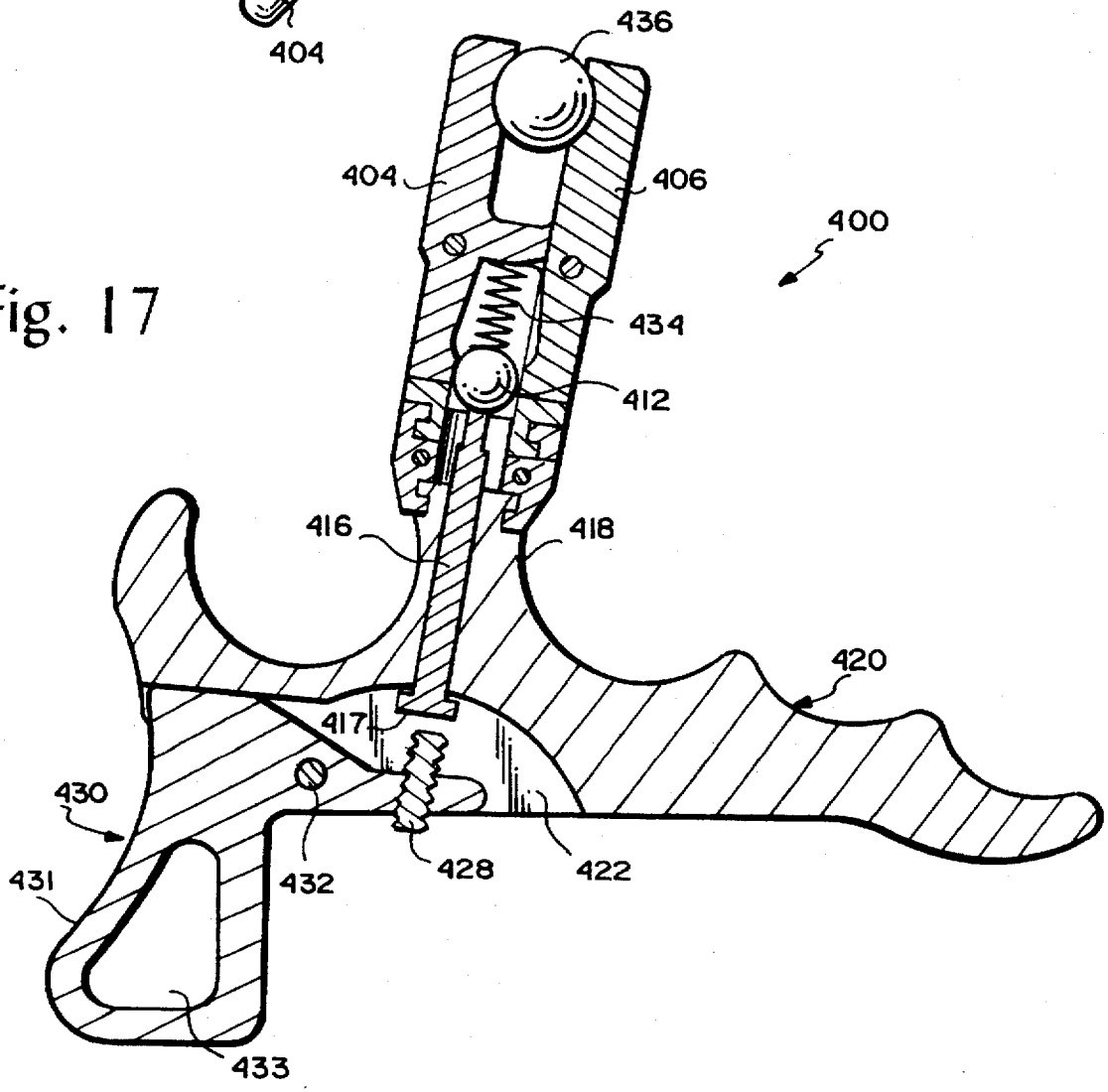
FIG. 17 is a section of the release mechanism shown in FIG. 16.

With reference now to FIGS. 16 and 17, a modified thumb actuated trigger is disclosed in a single nock release 400 which is otherwise of substantially similar construction as releases 200 and 300, with exceptions noted below. Accordingly, similar reference numerals are used to designate corresponding elements, but with the prefix "4" added.

In this fourth version, the first and second firing pins are formed as one integral pin 416. This pin is also formed with an enlarged rearward head or flange 417 which is adapted to be engaged by a set screw 428. The set screw 428 is adjustably mounted within a thumb trigger 430 pivotally secured by means of pin 432 within a hollowed out slot 422 in the T-handle 420. The thumb trigger 430 is provided with a curved thumb engaging surface 431 and is further characterized by a hollowed out center portion 433 which reduces the weight of the trigger. It will be appreciated from FIG. 17 that by engaging the thumb trigger 430 and pulling it in a counter-clockwise direction about the pin, the set screw 428 will engage the firing pin 416 via head 417 which in turn will cause the ball actuator 412 forwardly in the manner described hereinabove.

It should be noted here that the two firing pin arrangements in the releases illustrated in FIGS. 12–15 can also be provided in the form of a one-piece integral pin similar to that shown in FIGS. 16 and 17.

It is reiterated that in each of the release devices described hereinabove, the gripping arms may be altered so that the user may select a single nock, double nock or standard jaw configuration thereon. In addition, the user may specify 2, 3 or 4 finger engagement, coupled with a handle/trigger configuration of choice. The additional adjustability features permit the user to satisfy his or her preferences within the context of a lightweight and highly accurate release device.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bowstring release device comprising:

a first housing;

a pair of spring biased gripping arms pivotally secured within said first housing for movement toward and away from each other, said gripping arms each having at least one jaw;

ball actuator means mounted in said first housing for moving said gripping arms between open and closed positions;

a second housing secured to said first housing and axially aligned therewith;

a firing pin slidably mounted in said second housing and adapted for engagement with said ball actuator means; and a handle mechanism secured to said second housing and including an element adapted to operatively engage said firing pin.

2. The bowstring release device of claim 1 wherein each gripping arm jaw comprises a substantially semi-spherical socket adapted to engage a substantially ball-shaped nock.

3. The bowstring release device of claim 1 wherein said first housing is freely rotatable relative to said second housing about a common center axis.

4. The bowstring release of claim 3 wherein said handle mechanism is rotatably secured to said second housing for rotation with said second housing relative to said first housing about said center axis.

5. The bowstring release of claim 4 wherein said handle includes a trigger member pivotally secured thereto, said trigger member adapted to operatively engage said firing pin.

6. The bowstring release of claim 5 wherein said trigger member is pivotally secured within an open slot along a rearwardly face of the handle.

7. The bowstring release device of claim 1 wherein said ball actuator means comprises a coil spring and a ball element, said ball element located between said pair of gripping arms.

8. The bowstring release device of claim 7 wherein said ball element is secured to said firing pin.

9. The bowstring release device of claim 1 wherein said combined trigger and handle mechanism is pivotally secured to said second housing for rotation about an axis perpendicular to said common center axis.

10. The bowstring release device of claim 1 wherein each gripping arm is provided with a pair of jaws.

11. A bowstring release device comprising:

a first housing;

a pair of spring biased gripping arms pivotally secured within said first housing for movement toward and away from each other, wherein each gripping arm is provided with a pair of jaws, each comprising a substantially semi-spherical socket adapted to engage a corresponding pair of substantially ball-shaped nocks;

a ball actuator mounted in said first housing between said gripping arms;

a second housing secured to said first housing and axially aligned therewith;

a firing pin slidably mounted in said second housing and adapted for engagement with said ball actuator so as to move said ball actuator axially toward said jaws and to thereby permit said gripping arms to move to an open release position; and a handle mechanism secured to said second housing and including an element adapted to operatively engage said firing pin.

12. A bowstring release device comprising:

a first housing;

a pair of spring biased gripping arms pivotally secured within said first housing for movement toward and away from each other, said gripping arms each having at least one jaw;

a ball actuator mounted in said first housing, between said gripping arms, for causing said gripping arms to move between open and closed positions, wherein said ball actuator is engaged by one end of a spring which biases the ball actuator in a direction corresponding to said closed position;

a second housing secured to said first housing and axially aligned therewith;

a firing pin slidably mounted in said second housing and adapted for engagement with said ball actuator;

a handle mechanism secured to said second housing and including an element adapted to operatively engage said firing pin; and wherein said gripping arms each include a surface engaging an opposite end of said spring and located intermediate forward and rearward ends of said gripping arms, and another surface engaging said ball and located between said spring and said rearward end.

13. The bowstring release device of claim 12 wherein said firing pin is connected to said ball element.

14. A bowstring release device comprising:

a first housing;

a pair of spring biased gripping arms pivotally secured within said first housing for movement toward and away from each other, said gripping arms each having at least one jaw;

ball actuator means mounted in said first housing for moving said gripping arms between open and closed positions;

a second housing secured to said first housing and axially aligned therewith;

a firing pin slidably mounted in said second housing and adapted for engagement with said ball actuator means; and a combined handle and trigger mechanism pivotally secured to said second housing for rotation about an axis perpendicular to said common center axis, and including an element adapted to operatively engage said firing pin; and further wherein said combined trigger and handle mechanism includes a hand grip and a hinge pin threadably secured in said hand grip and projecting from said hand grip, said hinge pin being pivotally mounted in said second housing, and wherein said hinge pin includes adjustable means for engaging said firing pin.

15. The bowstring release device of claim 14 wherein said hinge pin includes a flange mounting an adjustable screw engageable with said firing pin.

16. The bowstring release of claim 15 wherein said firing pin is provided with means for engaging an underside of said flange for preventing misfiring.

17. A bowstring release device comprising:

a first housing;

a pair of spring biased gripping arms pivotally secured within said first housing for movement toward and away from each other, said gripping arms each having at least one jaw;

ball actuator means mounted in said first housing for moving said gripping arms between open and closed positions;

a second housing secured to said first housing and axially aligned therewith, and wherein said first housing is freely rotatable relative to said second housing about a common center axis;

a firing pin slidably mounted in said second housing and adapted for engagement with said ball actuator means; and a handle secured to said second housing and including a trigger member pivotally secured within an open slot along a rearward face of the handle, said trigger member adapted to operatively engage said firing pin;

wherein said handle mechanism is secured to said second housing for rotation with said second housing relative to said first housing about said center axis, said handle including a trigger member pivotally secured thereto, said trigger member adapted to operatively engage said firing pin; and further wherein said handle includes a second firing pin extending through said handle and into engagement with said first firing pin.

18. The bowstring release of claim 17 wherein said trigger member is fitted with an adjustable member adapted for engagement with said second firing pin.

19. A bowstring release device comprising:

a housing;

a pair of gripping arms, each having at least one jaw and each having ball engagement surfaces thereon; said arms pivotally secured in said housing for movement between closed gripping and open releasing positions;

a ball actuator mounted in said housing and movable axially along grooves formed in said housing and along said ball engagement surfaces of said gripping arms;

a spring extending axially between said gripping arms, one end of said spring engaging said gripping arms and an opposite end of said spring engaging said ball actuator, said ball actuator normally biased to a position between rearward ends of said gripping arms to thereby hold said gripping arms in the closed gripping position;

a firing pin axially aligned and engageable with said ball actuator; and a handle for effecting movement of said firing pin and said spring biased ball actuator so as to cause said ball actuator to move forwardly, permitting said gripping arms to move from said closed gripping to said open releasing position.

20. The bowstring release device of claim 19 wherein said handle is rotatable about an axis perpendicular to a longitudinal center axis of said housing and said firing pin.

21. The bowstring release device of claim 20 wherein said handle pivotally mounts a trigger, said trigger having an adjustable member operatively engageable with said firing pin.

22. The bowstring release of claim 21 and including a second housing axially aligned with said first housing and rotatable relative to said first housing, and further wherein said handle is connected to said second housing for rotation about said longitudinal center axis relative to said first and second housings.

23. The bowstring release of claim 21 wherein said trigger is a thumb actuated member pivotally secured to said handle.

24. The bowstring release of claim 21 wherein said trigger is a pinky actuated member pivotally secured to said handle.

25. The bowstring release of claim 21 wherein said trigger is mounted in an open slot formed in a rearward face of said handle.

26. The bowstring release device of claim 19 wherein said one end of said spring engages a pair of projections formed on said gripping arms substantially adjacent said jaws.

27. The bowstring release device of claim 26 wherein said spring is a coil spring.

28. The bowstring release device of claim 26 wherein said ball engagement surfaces are located axially rearwardly of said pair of projections and, for each gripping arm, comprise a curved ramp surface terminating at a flat surface, said ball engagement surfaces arranged such that, when said ball actuator is seated on said flat surfaces, said gripping arms are in said closed gripping position.

29. The bowstring release device of claim 19 wherein each gripping arm is provided with a pair of jaws.

30. The bowstring release device of claim 19 wherein each gripping arm jaw comprises a substantially semi-spherical socket adapted to engage a substantially ball-shaped nock.

31. The bowstring release device of claim 19 wherein each gripping arm is provided with a pair of jaws, each comprising a substantially semi-spherical socket adapted to engage a corresponding pair of substantially ball-shaped nocks.

32. The bowstring release device of claim 19 wherein said handle is formed with a plurality of finger engagement grooves.

33. The bowstring release device of claim 19 wherein said ball actuator is attached to said pin and rotatable relative to said pin.

* * * * *